US009541277B2

(12) United States Patent
Germain

(10) Patent No.: US 9,541,277 B2
(45) Date of Patent: Jan. 10, 2017

(54) WATERTIGHT PLASTIC LAMP SEAL

(75) Inventor: Steve Germain, Lachine (CA)

(73) Assignee: GE LIGHTING SOLUTIONS, LLC, Cleveland, OH (US)

( * ) Notice: Subject to any disclaimer, the term of this patent is extended or adjusted under 35 U.S.C. 154(b) by 1184 days.

(21) Appl. No.: 13/074,322

(22) Filed: Mar. 29, 2011

(65) Prior Publication Data

US 2012/0250307 A1 Oct. 4, 2012

(51) Int. Cl.

| | |
|---|---|
| ***F21V 31/00*** | (2006.01) |
| ***F21V 3/00*** | (2015.01) |
| *F21K 99/00* | (2016.01) |
| *F21V 15/01* | (2006.01) |
| *F21W 111/00* | (2006.01) |
| *F21W 111/02* | (2006.01) |
| *F21Y 101/00* | (2016.01) |

(52) U.S. Cl.

CPC ..... *F21V 31/005* (2013.01); *F21V 3/00* (2013.01); *F21K 9/00* (2013.01); *F21V 15/012* (2013.01); *F21W 2111/00* (2013.01); *F21W 2111/02* (2013.01); *F21Y 2101/00* (2013.01); *Y10T 29/49002* (2015.01)

(58) Field of Classification Search

CPC ..... F21Y 2101/02; F21V 5/04; F21V 13/04; F21K 9/00; F21S 4/003; B60Q 1/34

USPC ..... 362/158, 373

See application file for complete search history.

(56) References Cited

U.S. PATENT DOCUMENTS

| | | | | |
|---|---|---|---|---|
| 4,259,710 | A | 3/1981 | Schlack | |
| 4,556,933 | A | 12/1985 | Mendoza | |
| 5,016,151 | A * | 5/1991 | Mula | 362/267 |
| 6,616,299 | B2 | 9/2003 | Martineau et al. | |
| 7,093,953 | B1 | 8/2006 | Dicke et al. | |
| 7,237,924 | B2 * | 7/2007 | Martineau et al. | 362/231 |
| 7,553,044 | B2 * | 6/2009 | Wedell | 362/247 |
| 7,806,550 | B2 * | 10/2010 | Tyson et al. | 362/153 |
| 7,972,038 | B2 * | 7/2011 | Albright et al. | 362/311.02 |
| 7,988,451 | B2 * | 8/2011 | Battaglia, Jr. | 434/267 |
| 8,201,606 | B2 * | 6/2012 | Specht et al. | 156/515 |
| 2002/0089419 | A1 | 7/2002 | Martineau | |

(Continued)

FOREIGN PATENT DOCUMENTS

| | | |
|---|---|---|
| EP | 2019250 A1 | 1/2009 |
| FR | 2746902 A1 | 10/1997 |
| WO | 2009012314 | 1/2009 |

OTHER PUBLICATIONS

PCT Search Report and Written Opinion dated Oct. 11, 2012 from corresponding Application No. PCT/US2012/030243.

*Primary Examiner* — Jong-Suk (James) Lee
*Assistant Examiner* — Mark Tsidulko
(74) *Attorney, Agent, or Firm* — Fay Sharpe LLP

(57) ABSTRACT

In accordance with one aspect of the present disclosure, a waterproof LED lamp is disclosed. The waterproof LED lamp includes a housing having one or more LEDs disposed within said housing. The housing comprises a housing base including a body with a first opening, the first opening having an edge surrounded by a first sealing portion. The housing further includes an optical cover comprising a shell having a second opening, the second opening having a border surrounded by a second sealing portion. The second sealing portion is configured to be removably inserted into the first sealing portion, forming a water-tight seal between the housing base and the optical cover.

20 Claims, 11 Drawing Sheets

(56) References Cited

U.S. PATENT DOCUMENTS

| | | | |
|---|---|---|---|
| 2004/0252520 | A1 | 12/2004 | Martineau et al. |
| 2010/0208460 | A1 | 8/2010 | Ladewig et al. |

* cited by examiner

WATERTIGHT PLASTIC LAMP SEAL

FIELD OF THE INVENTION

The following relates generally to illumination arts, lighting arts, solid state lighting arts, and related arts, and find particular application in conjunction with LED lighting systems and, in particular, traffic signals. However, it is to be appreciated that the present exemplary embodiments are amenable to other like applications.

BACKGROUND OF THE DISCLOSURE

LED signals, such as LED traffic signals, present numerous advantages over incandescent lamp traffic signals. The use of LEDs provides a power consumption savings and extremely long life compared to incandescent light sources. The long life span of the LED signals leads to improved reliability and lower maintenance costs.

Due to the large number of existing incandescent traffic signals, most LED signals are designed for incandescent lamps. In order to meet existing signal standards and/or allow retrofitting into signals originally manufactured for use with incandescent light sources, LED signals mimic the front housing diameter and depth restrictions of the prior incandescent signals. To allow for an easy retrofit without requiring significant changes to the preexisting AC power distribution and logic circuits, LED signal assemblies typically incorporate a power supply to drive the LEDs at a lower, controlled, direct current power level.

LED signal lamps generally include a housing designed to be retrofit into existing incandescent traffic light signals, and is closed with a cover. Since the LED signal lamps are implemented substantially outside subject to nature's elements, it is important that the lamp is impervious to water. Typically, signal lamps are designed such that a watertight seal is created between the housing and cover with the use of an o-ring or gasket, such as is described in U.S. Pat. No. 7,237,924, the disclosure of which is fully incorporated herein. The o-ring provides a dust and water-resistant seal and is preferably made of EPDM material. However, the use of an o-ring or gasket creates the need for additional parts and therefore increases cost of production. It is therefore desirable to create an LED signal lamp capable of forming a watertight seal between the housing and cover without the use of an o-ring or gasket, thereby reducing costs and part count, while improving ease of assembly.

SUMMARY OF THE DISCLOSURE

In accordance with one aspect of the present disclosure, a waterproof LED lamp is disclosed. The waterproof LED lamp includes a housing having one or more LEDs disposed within the housing. The housing comprises a housing base including a body with a first opening, the first opening having an edge surrounded by a first sealing portion. The housing further includes an optical cover comprising a shell having a second opening, the second opening having a border surrounded by a second sealing portion. The second sealing portion is configured to be removably inserted into the first sealing portion, forming a water-tight seal between the housing base and the optical cover.

In accordance with another aspect of the present disclosure, a method for forming a watertight seal in an LED signal lamp having a housing is provided. The housing includes a housing base with a first sealing portion and an optical cover with a second sealing portion. The method comprises providing the first sealing portion with a rim, the rim including a first lip extending from the innermost portion of the rim, a second lip extending from the outermost portion of the rim, and two central lips extending between said inner and outer lips, and providing the second sealing portion with a flange, the flange including an outer lip located on an outer edge of the flange and an inner lip extending from an inner edge of the flange. The method further includes removably inserting the inner lip between the central lips, forming a first seal between the first and second sealing portions and extending the outer lip around the second lip, forming a second seal between the first and second sealing portions.

In accordance with yet another embodiment, a watertight sealing arrangement for an LED lamp is provided. The watertight sealing arrangement comprises a first sealing portion positioned on a housing base, the sealing portion comprising a rim extending outwardly from the housing base and including an innermost portion having a first lip extending therefrom, an outermost portion having a second lip extending therefrom, and at least two central lips extending therebetween. The sealing arrangement further includes a second sealing portion located on an optical cover, the second sealing portion comprising a flange extending outwardly from the optical cover, the flange having an inner lip and an outer lip. The second sealing portion is configured to form at least one water-tight seal with the first sealing portion.

DETAILED DESCRIPTION OF THE PREFERRED EMBODIMENTS

Figure 1:
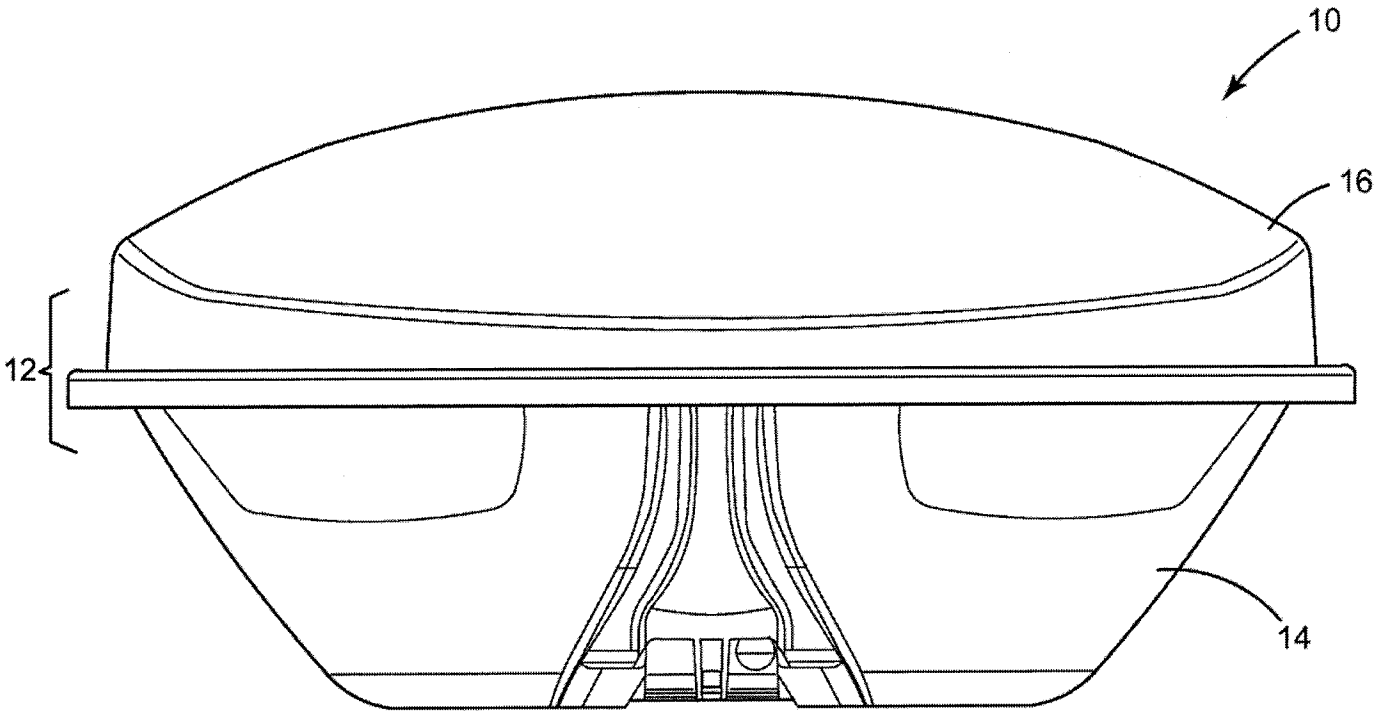
FIG. 1 illustrates a three-dimensional side view of an LED lamp in accordance with one aspect of the present disclosure.
Figure 2:
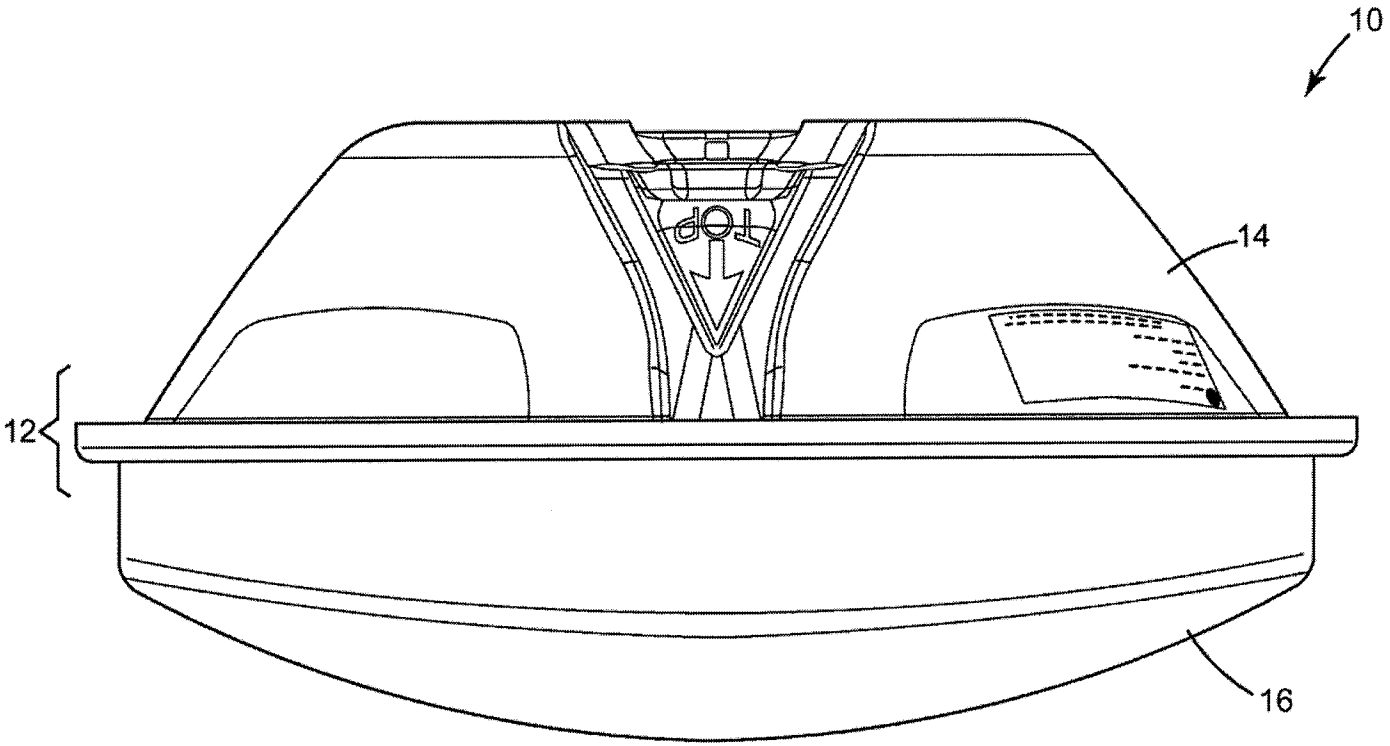
FIG. 2 illustrates a three-dimensional side view of an LED lamp in accordance with another aspect of the present disclosure.

Referring to FIGS. 1 and 2, a signal lamp 10 according to a first exemplary aspect is illustrated. The signal lamp includes a housing assembly 12 containing one or more light sources, for example LEDs (not shown). FIG. 1 depicts one aspect of a signal lamp housing assembly 12 aligned vertically, such that light emits from of the top portion. FIG. 1 illustrates the opposite configuration, with the light emitting portion facing in a downward direction. The housing may be formed from a plastic material, such as polycarbonate, or other suitable material, such as metal, etc. Polycarbonate has excellent strength and impact resistance characteristics. The housing assembly 12 is designed to be retrofit into existing incandescent traffic light signals.

Figure 3:
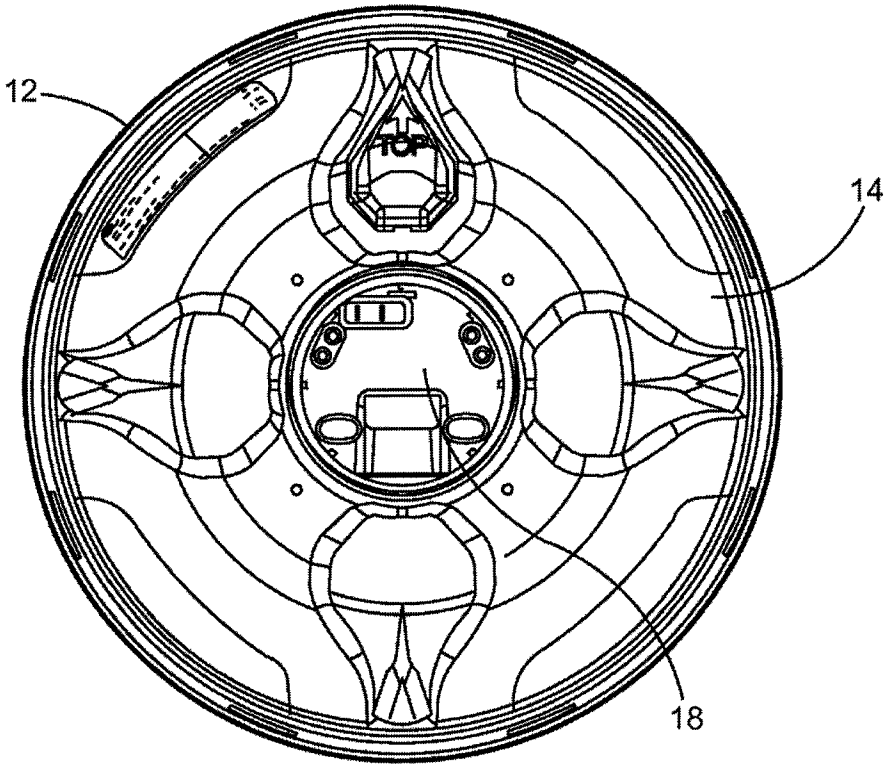
FIG. 3 illustrates a rear view of an LED lamp in accordance with another aspect of the present disclosure.
Figure 4:
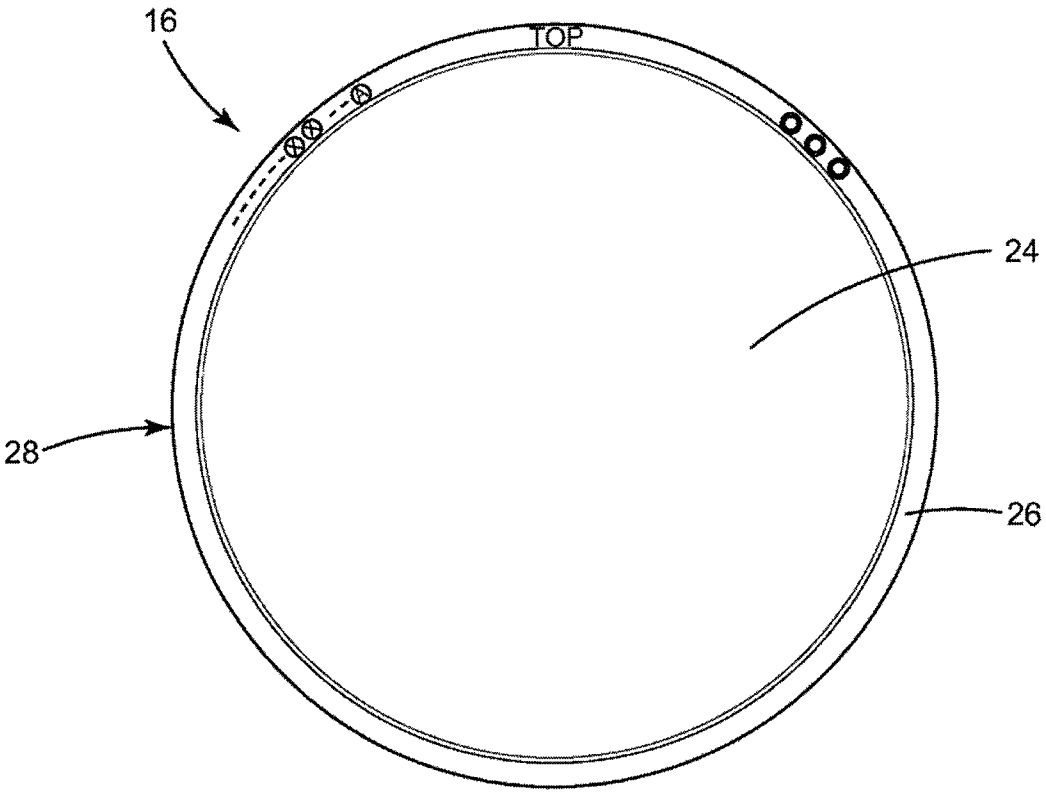
FIG. 4 illustrates a front view of an LED lamp in accordance with yet another aspect of the present disclosure.

The housing assembly 12 preferably comprises two complementary, generally semi-circular portions, a base portion and an optical cover portion 16, each designed to mate with the other, forming a sealed housing that is impervious to water. Although it is preferred that each housing assembly portion comprises a generally semi-circular configuration, other shapes and configurations may alternatively be implemented depending on particular design needs. The housing base 14, best illustrated in FIG. 3, includes a body 18 and a base opening 20. The edge of the base opening 20 is surrounded by a first sealing portion 22. The optical cover 16, best illustrated in FIG. 4, preferably comprises a transparent and optically neutral shell 24 that has a cover opening 28 at one end. The shell 24 may be transparent or tinted, such as red, yellow, green, or smocked. Additionally, the shell 24 includes an inner surface that may be covered by small lenses. The lenses may be of various shapes and sizes. In one exemplary embodiment, the lenses are about 5 mm.times.5 mm. The optical cover 16 further includes a second sealing portion 26 extending around the perimeter of the cover opening 28. The shell 24 is preferably generally smooth so that opportunities for dirt built up on the outer surface are minimized. Alternatively, however, the optical cover 16 may be tinted or at least partially textured as a means for diffusing the signals display aspect to obscure any imperfections/design losses/shadows in the optical solution. The optical cover is preferably constructed out of a light transmissive material, such as polycarbonate or other optically acceptable quality and/or cost effective material. The present housing assembly 12 may be easily retrofit into an existing traffic signal or other such lighting base upon removal of the original outer lens and incandescent lamp. The outer rim edge of the housing assembly 12 may be designed such that it is the same size as the lens it replaces.

Figure 5:
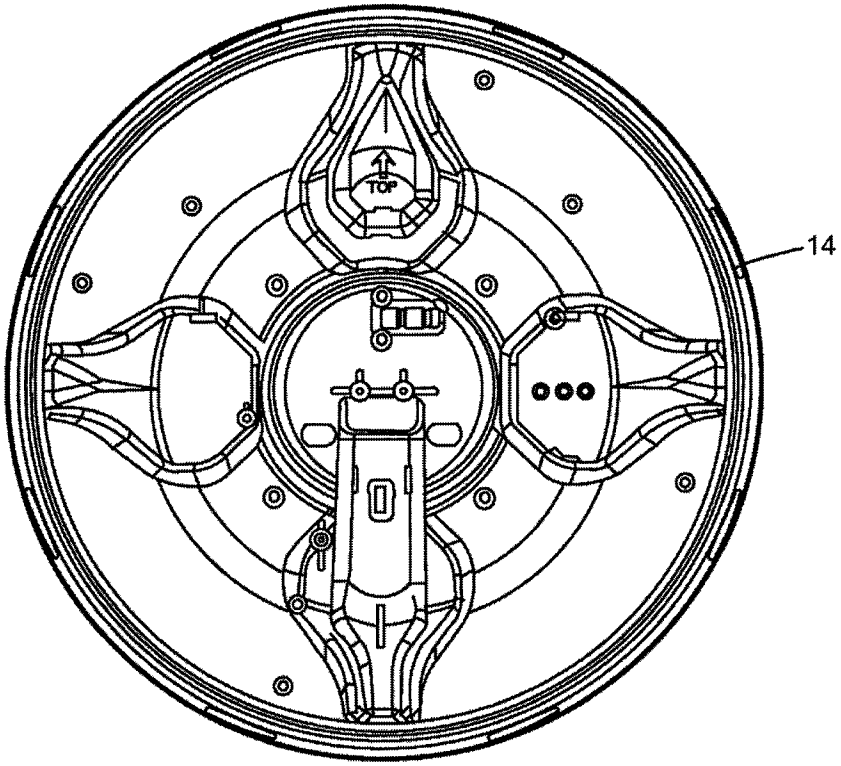
FIG. 5 illustrates a three dimensional view of the inside portion of the housing base of an LED lamp in accordance with yet another aspect of the present disclosure.
Figure 6:
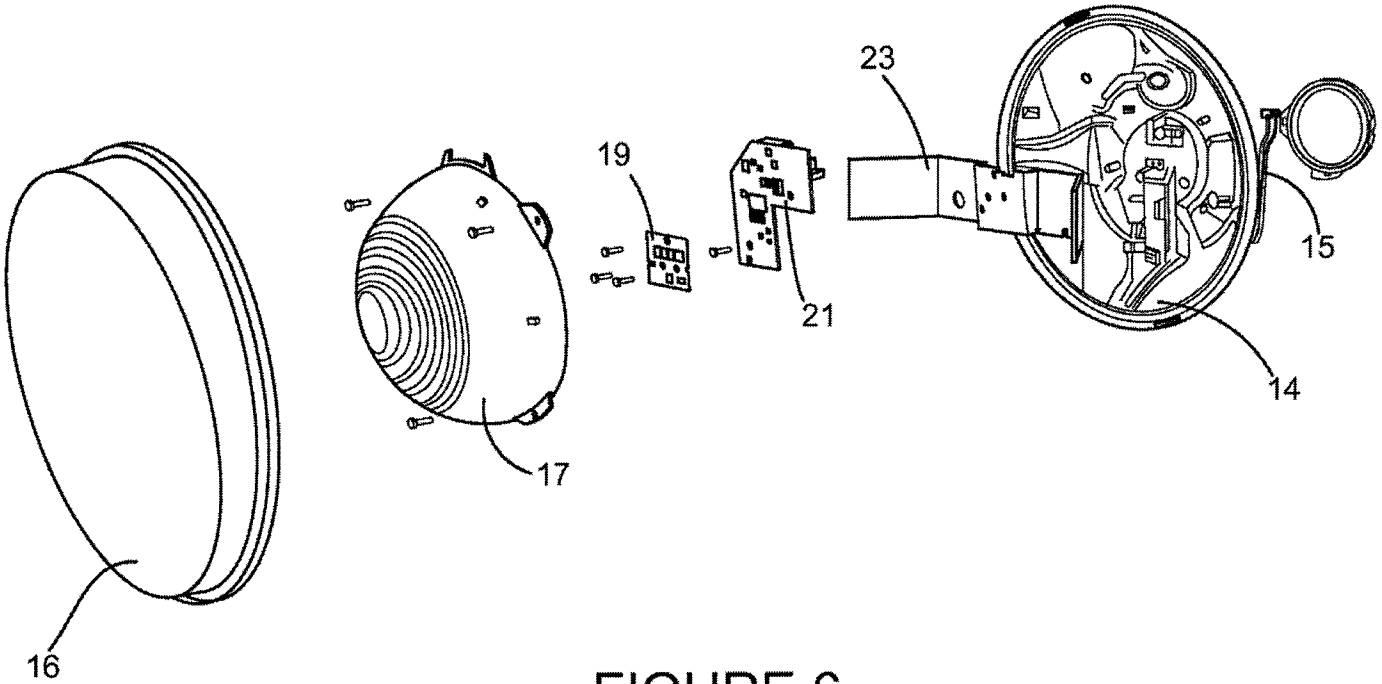
FIG. 6 illustrates an exploded perspective view of an LED lamp in accordance with another aspect of the present disclosure.

FIG. 5 illustrates the interior portion of the housing base 14. For clarity, internal components comprising, for example, a power supply, circuit boards, LED, and any circuitry, are omitted. FIG. 6 illustrates an exploded view of a signal lamp 10 including internal components, including, but not limited to, a power supply 21, LED board 19, a heat sink 23, and lens 17. The power supply may be digital and have a programmable chip on it. Optional printed circuit boards (not shown) can be connected to the power supply via card edge connectors (not shown) and communicate with the power supply chip. The power supply 21 is directly connected (board to board connection) to the LED board 19. The LED board 19 has at least one LED on it, and preferably 3 or 4 LEDs. Since all the boards are directly connected together, currently, there are no wires inside the lamp. The only wires may comprise the external power wire 15.

Figure 7:
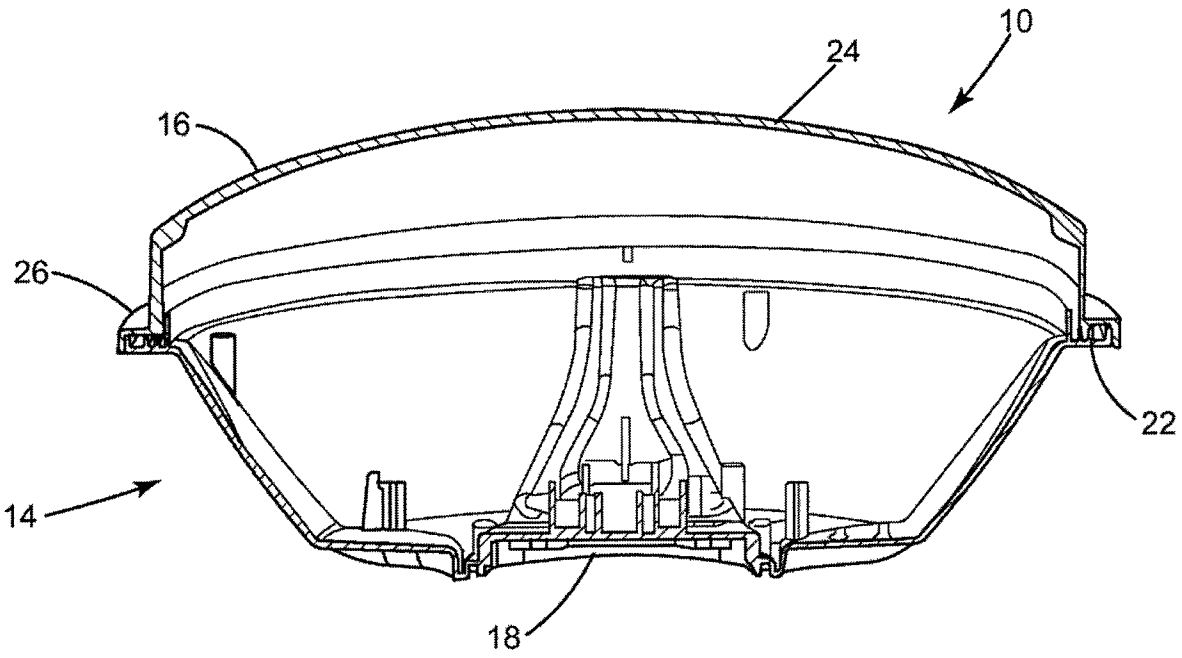
FIG. 7 illustrates a three-dimensional cross-sectional side view of an LED lamp in accordance with yet another aspect of the present disclosure.
Figure 8:
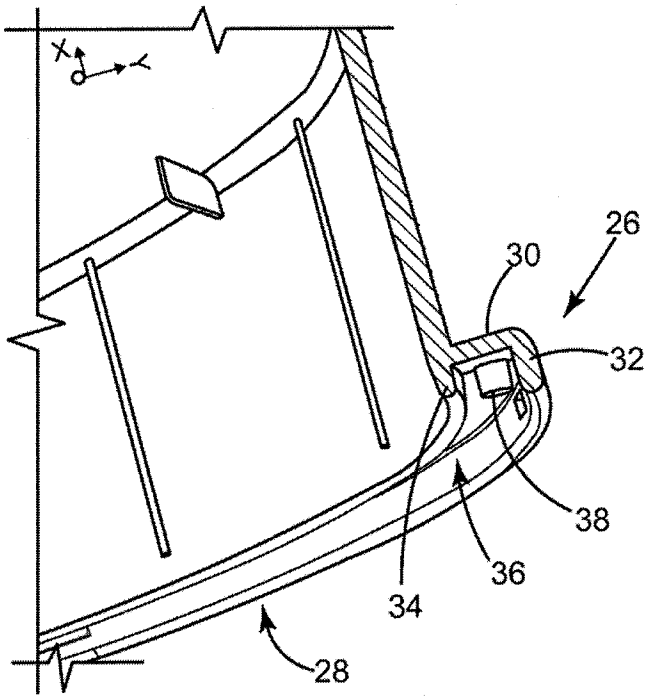

FIGS. 7-10 illustrate cross-sectional aspects of one embodiment of the optimized sealing arrangement of the present LED signal lamp 10. The optimized sealing arrangement creates a watertight seal between the optical cover and the housing base and provides environmental isolation for the inside of the LED signal without the use of an o-ring or gasket. Accordingly, this arrangement allows for plastic-on-plastic sealing, such that the plastic of each housing assembly portion achieves and maintains full contact throughout the entire seal, removing any need for an o-ring or gasket. As best illustrated in FIG. 7, the optical cover 16 and housing base 14 are mated together, with the second sealing portion 26 being removably inserted into the first sealing portion 22, forming a watertight seal between the optical cover 16 the housing base 14, using only the plastic or other material present in the parts. Eliminating the need for additional parts eliminates the added cost and assembly steps that are necessarily incurred when additional parts are required. This also improves efficiency, since less time is spent making and assembling parts. Referring to FIG. 8, a zoomed-in view of the cross-sectioned optical element 16 is illustrated, which focuses on the second sealing portion 26 surrounding the opening 28 of the optical element 16. The second sealing portion 16 includes a flange 30 extending around the outer edge of the optical element opening 28. The outermost portion of the flange 30 includes an outer lip 32 and the innermost portion includes an inner lip 34. The space between the inner 34 and outer lips 32 forms a notch 36 that extends along the bottom the flange 30 around the circumference of the optical element opening. Additionally, one or more plastic chunks 38 are located at various positions in the notch around the flange. These chunks are used to ensure the correct molding parameters have been used to mold the part. The chunk will not fill completely if one or more of the pressure and temperature is not correct when the molding occurs.

Figure 9:
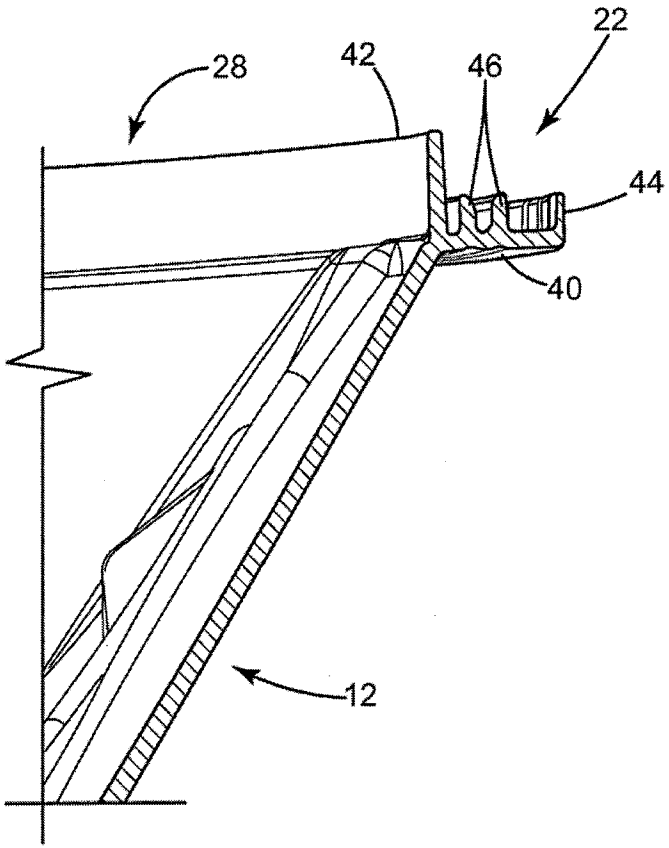
FIGS. 8 and 9 illustrate a three dimensional cross-sectional detail view of the sealing portions of an LED lamp in accordance with yet another aspect of the present disclosure.

FIG. 9 illustrates a zoomed-in aspect of the first sealing portion 22 located on the housing base 14. The first sealing portion 22 includes a rim 40 extending outwardly around the circumference of the base opening 20, similar to the flange 30 of the optical cover 16. The innermost portion of the rim 40 includes a first lip 42 extending a particular height from the rim 40, preferably between about 9 and 10 mm, and more preferably about 9.55 mm, away from the housing base 14. Obtaining an optimal height of the first lip 42 is important for the function of the lamp. A taller first lip 42 is desirable for sealing and minimizing the forces applied on the parts required to seal. However, the higher the ribs, the thicker the flange will be, thereby reducing the ability of the lamp to fit in all the street housings where it is intended to be installed. The first lip 42 extends around the circumference of the opening 20 of the housing base 14.

Figure 10:
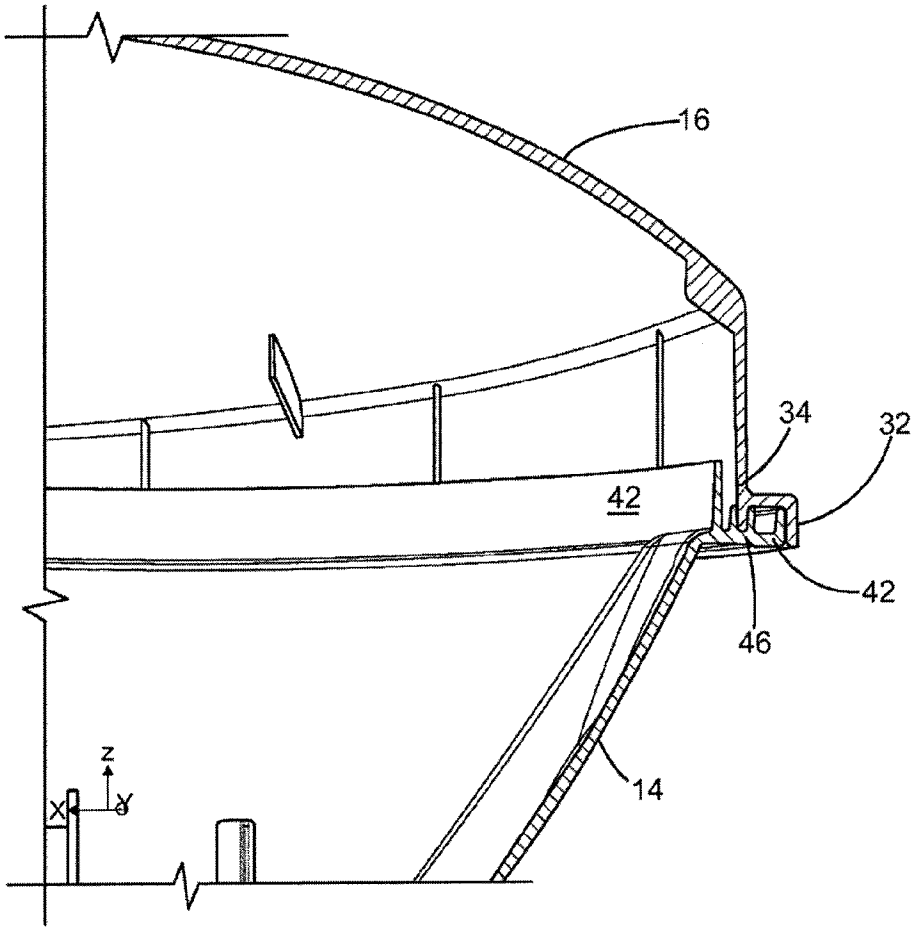
FIG. 10 illustrates a three dimensional cross-sectional side detail view of the sealing aspect of an LED lamp in accordance with the present disclosure.

A second lip 44 extends from the outermost portion of the rim 40 away from the housing base 14 in the same direction as the first lip 42. Two central lips 46 are located between the first 42 and second lips 44 of the rim 40 and extend away from the housing base 14 in the same direction as the first 42 and second lips 44. The central lips 46 spaced apart from one another a distance consistent with the width of the inner lip 34 of the flange 30, such that the central lips 46 are configured to removably accept the inner lip 34, as best illustrated in FIG. 10. The central lips 46 are preferably tapered, such that when the inner lip 34 is inserted between central lips 46, a self-locking arrangement is created, forming a first secure seal between the optical cover 16 and the housing base 14. Preferably, the inner lip 34 has less than about a 5.degree. taper, and more preferably an approximately 2.degree.taper on each side. Additionally, the inside of the central lips initially comprise less than approximately 1.degree.taper, and preferably 0.5.degree.taper. As the optical cover 16 is mated with the housing base 14, the two central lips 46 will deform until they match the taper of the first lip 34. As the surfaces of the central lips 46 and inner lip 34 match together, a seal is formed.

Moreover, first lip 42 preferably has a height that is greater than the heights of any of the central lips 46 and second lip 44, such that as the optical element 16 is mated with the housing base 14, the first lip 42 extends into the optical element opening. The first lip 42 creates an additional barrier protecting the internal components from any potential water or other environmental elements that may manage to get through the first seal.

As the inner lip 34 is inserted between the central lips 46, the outer lip 32 of the optical cover 16 fits securely around the outside of the second lip 44 of the rim 40, forming a second sealing arrangement between the optical cover 16 and housing base 16, which is further illustrated in FIG. 7(*c*). Accordingly, the present optimized sealing arrangement creates a double seal between the housing base 14 and optical cover 16, which ensures that the LEDs enclosed therein are fully protected from water and other outdoor elements.

One issue encountered in molding applications for parts with large diameters, such as signal lamps having diameters of generally about 200-300 mm, is that the parts often come out of a mold having a generally oval shape, rather than being perfectly circular. This may cause difficulty when trying to mate two parts, since the mating aspects of the parts may not perfectly align as required for successful mating. Often this leads to part-waste, since parts that are unable to form a necessary whole are useless. The present optimized sealing method overcomes this issue by designing at least one of the housing assembly portions to be flexible to allow for deformation during the mating process. By providing at least one of the housing assembly portions with flexibility, it can be manipulated into mating with a complementary housing assembly portions, even if the parts are not perfectly circular. As such, the housing assembly portions will be capable of successfully mating together and part waste will be reduced.

Figure 11B:
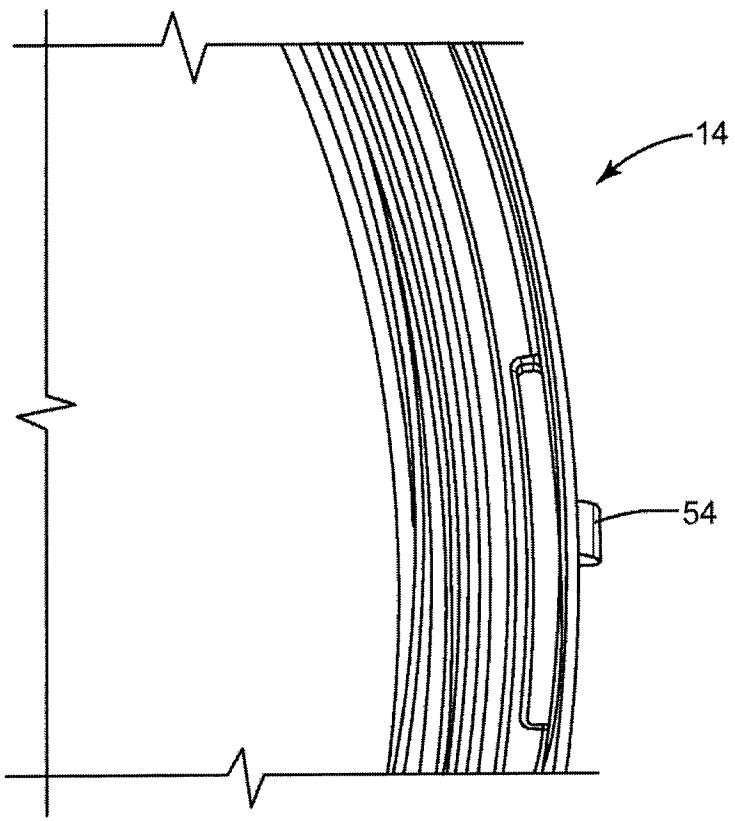
FIGS. 11(*a*)-(*c*) illustrate a three-dimensional cross-sectional view of clips used to further secure the LED lamp in accordance with another aspect of the present disclosure.
Figure 11A:
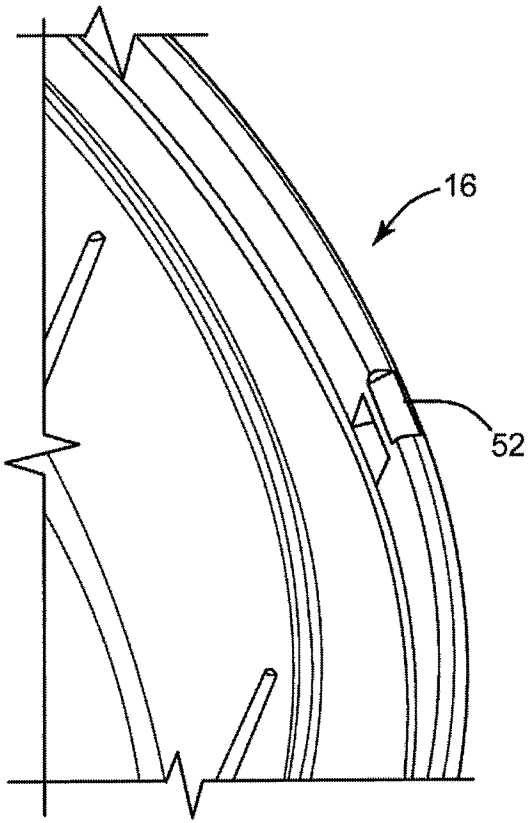
Figure 11C:
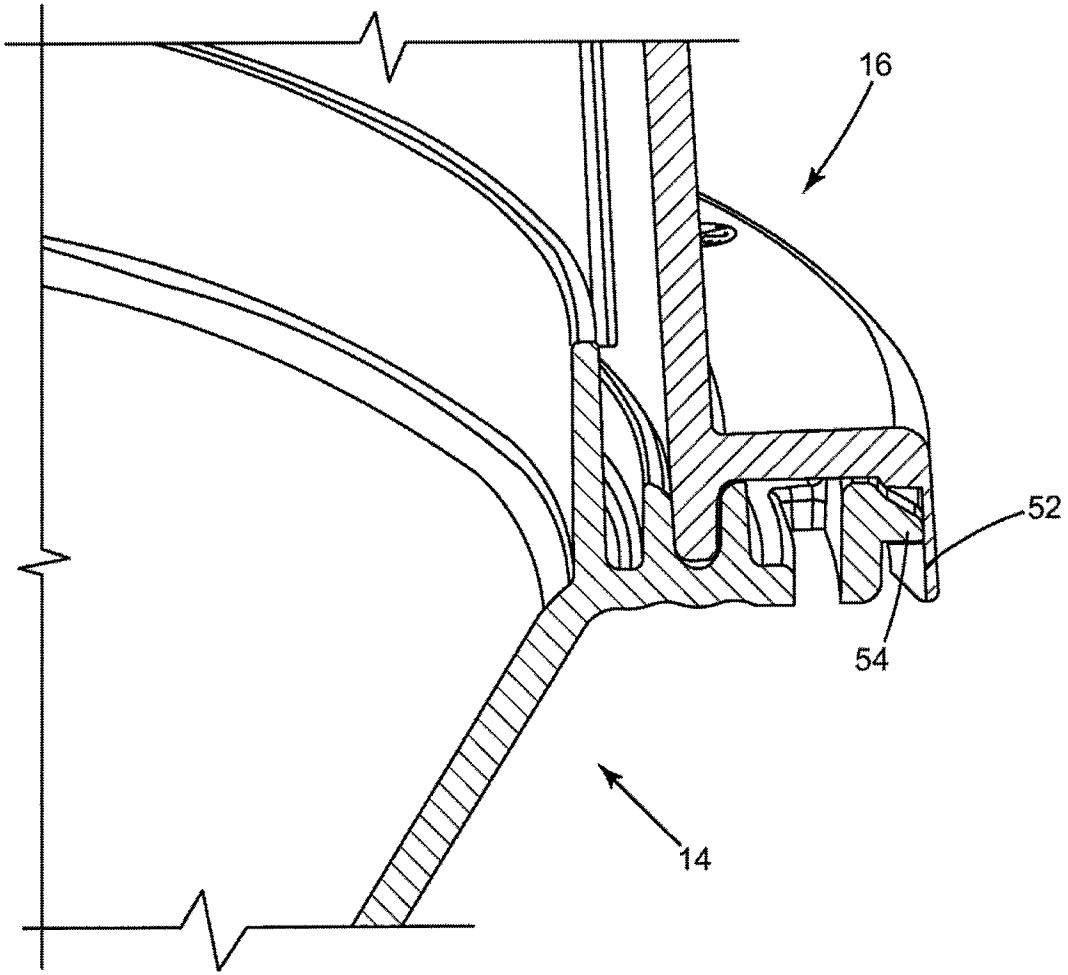

Once the housing assembly portions are mated, the portions may optionally be further secured together with the use of upper clips 52 located in one or more locations around the optical cover 16, as illustrated in FIG. 11(*a*). The upper clips 52 comprise a hook-like portion in the outer lip 32 (FIG. 11(*b*)) that clips under a lower clip 54, securing the cover to the base portion, as illustrated in FIG. 11(*c*). Preferably, there are about eight sets of upper and lower clips located around the optical cover and housing base, respectively.

In another exemplary aspect of the disclosure, a method is provided for forming such a watertight seal in the present LED signal lamp housing 12 assembly. The method includes molding the housing assembly portions in such as manner as to provide the housing base portion 14 and the optical cover portion 16 with sealing portions capable of mating and providing a watertight seal, without the need for an o-ring, gasket, or the like. The housing base 14 is provided with a first sealing portion 22 with a rim 40 including a first lip 42 extending from the innermost portion of the rim 22, a second lip 44 extending from the outermost portion of the rim 40, and two or more central lips 46 extending between the inner and outer lips. The optical cover 16 is provided with a second sealing portion 26 having a flange 30 that includes an outer lip 32 located on an outer edge of the flange and an inner lip 34 extending from an inner edge of the flange 30. The inner lip 34 of the flange 30 may be removably inserted between the central lips 46. A self-locking interaction between the tapers of the central lips 46 and inner lip 34. This self-locking interaction creates a first seal between the optical element and the housing base. The outer lip 32 of the flange may then be extended around the second lip 44, forming a second seal between the optical element 16 and housing base 14. The housing preferably includes one of the two seals, although both of the two seals do not need to be present to form a water-tight seal. At least one of the housing assembly portions is preferably constructed out of flexible material, such that the portions can be deformed in order to achieve one or both of the seals.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A waterproof LED lamp comprising:

a housing having one or more LEDs disposed therein, said housing comprising:

a housing base including a body with a first opening, said first opening having an edge surrounded by a first sealing; and an optical cover comprising a shell having a second opening, said second opening having a border surrounded by a second sealing portion, said second sealing portion being configured to be removably inserted into said first sealing portion, forming a water-tight seal between said housing base and said optical cover;

wherein at least one of said optical cover and said housing base comprises polycarbonate;

wherein said first sealing portion includes a rim, said rim having an innermost portion with a first lip, an outermost portion with a second lip, and a pair of central lips disposed therebetween;

wherein the first lip extends to a height greater than the height of the second lip.

2. The waterproof LED lamp of claim 1, wherein at least one of said housing base and said optical cover is deformable.

3. The waterproof LED lamp of claim 1, wherein said optical cover comprises one or more upper clips configured to hook under one or more complementary lower clips located on said housing base.

4. The waterproof LED lamp of claim 1, wherein said at least one water-tight seal is formed without the use of an o-ring or gasket.

5. A waterproof LED lamp comprising:

a housing having one or more LEDs disposed therein, said housing comprising:

a housing base including a body with a first opening, said first opening having an edge surrounded by a first sealing; and an optical cover comprising a shell having a second opening, said second opening having a border surrounded by a second sealing portion, said second sealing portion being configured to be removably inserted into said first sealing portion, forming a water-tight seal between said housing base and said optical cover;

wherein at least one of said optical cover and said housing base comprises polycarbonate;

wherein said first sealing portion includes a rim, said rim having an innermost portion with a first lip, an outermost portion with a second lip, and a pair of central lips disposed therebetween;

wherein said second sealing portion includes a flange having an outer lip extending from the outermost portion of the flange, an inner lip extending from the innermost portion of the flange, and a notch extending along said flange between said inner and outer lips.

6. The waterproof LED lamp of claim 5, wherein said central lips are configured to removeably mate with said inner lip to form a first seal.

7. The waterproof LED lamp of claim 6, wherein said first seal is a self-locking seal between a tapered inner surface of said inner lip and tapered outer surfaces of said inner lip.

8. The waterproof LED lamp of claim 7, wherein said tapers are angled at less than 5.degree.

9. The waterproof LED lamp of claim 5, wherein said outer lip of the flange is configured to extend around the outside of said second lip of said rim, forming a second sealing arrangement between the housing base and the optical cover.

10. A method for forming a watertight seal in an LED signal lamp having a housing, the housing including a housing base with a first sealing portion and an optical cover with a second sealing portion, said method comprising:

providing said first sealing portion with a rim, said rim including a first lip extending from the innermost portion of the rim, a second lip extending from the outermost portion of the rim, and two central lips extending between said inner and outer lips;

providing said second sealing portion with a flange, said flange including an outer lip located on an outer edge of said flange and an inner lip extending from an inner edge of said flange;

removably inserting said inner lip between said central lips, forming a first seal between said first and second sealing portions; and extending said outer lip around said second lip, forming a second seal between said first and second sealing portions.

11. The method according to claim 10, wherein said watertight seal is formed without the use of either an o-ring or gasket.

12. The method according to claim 10, wherein at least one of said housing base and said optical cover is deformable.

13. The method according to claim 10, further including deforming at least one of the housing base and optical cover to create at least one of the first and second seals.

14. A watertight sealing arrangement for an LED lamp comprising:

a first sealing portion positioned on a housing base, said sealing portion comprising a rim extending outwardly from said housing base and including an innermost portion having a first lip extending therefrom, an outermost portion having a second lip extending therefrom, and at least two central lips extending therebetween; and a second sealing portion located on an optical cover, said second sealing portion comprising a flange extending outwardly from said optical cover, said flange having an inner lip and an outer lip, wherein said second sealing portion is configured to form at least one water-tight seal with said first sealing portion.

15. The sealing arrangement of claim 14, wherein said central lips are configured to accept said first lip, fowling a first seal between said first sealing portion and said second sealing portion.

16. The sealing arrangement of claim 15, wherein said tapers comprise an angle of less than about 5.degree.

17. The sealing arrangement of claim 14, wherein said first seal is a self-locking seal between a tapered inner surface of said inner lips and tapered outer surfaces of said inner lips.

18. The sealing arrangement of claim 14, wherein said outer lip of the flange is configured to extend around the outside of said second lip, forming a second seal between said first sealing portion and said second sealing portion.

19. The sealing arrangement of claim 14, wherein at least one of said housing base and said optical cover is formed from a deformable material.

20. The sealing arrangement of claim 14, wherein said at least one water-tight seal is formed without the use of an o-ring or gasket.

* * * * *